US007519319B2

(12) United States Patent
Matsui et al.

(10) Patent No.: US 7,519,319 B2
(45) Date of Patent: Apr. 14, 2009

(54) IMAGE FORMING DEVICE HAVING A SHEET DELAY TRANSFER MODE

(75) Inventors: Shinya Matsui, Osaka (JP); Hidehiro Tabuchi, Osaka (JP)

(73) Assignee: Kyocera Mita COrporation, Osaka (JP)

( * ) Notice: Subject to any disclaimer, the term of this patent is extended or adjusted under 35 U.S.C. 154(b) by 324 days.

(21) Appl. No.: 11/276,115

(22) Filed: Feb. 14, 2006

(65) Prior Publication Data

US 2006/0182473 A1 Aug. 17, 2006

(30) Foreign Application Priority Data

Feb. 15, 2005 (JP) ..... 2005-037789

(51) Int. Cl.
*G03G 15/01* (2006.01)

(52) U.S. Cl. ..... 399/302; 399/16; 399/18; 399/19

(58) Field of Classification Search ..... 399/16, 399/18, 19, 302
See application file for complete search history.

(56) References Cited

U.S. PATENT DOCUMENTS 6,002,890 A * 12/1999 Jackson et al. ..... 399/18
2003/0016969 A1* 1/2003 Sawai ..... 399/297

FOREIGN PATENT DOCUMENTS

JP 08025759 A * 1/1996
JP 11/311921 A 11/1999

* cited by examiner

*Primary Examiner*—David M Gray
*Assistant Examiner*—Ryan D Walsh
(74) *Attorney, Agent, or Firm*—Global IP Counselors, LLP

(57) ABSTRACT

An image forming device includes an intermediate transfer member to which a toner image formed on an image bearing member is primarily transferred and which is able to simultaneously support a plurality of toner images, a secondary transfer member for secondarily transferring a toner image held on the intermediate transfer member to a sheet, a cleaning unit for removing the toner images from the intermediate transfer member after the secondary transfer, and a feeding member for feeding a sheet into the secondary transfer member. The secondary transfer member features a sheet-delay transfer mode in which a subsequent toner image on the intermediate transfer member is transferred if a previous toner image on the intermediate transfer member is out of sync with the timing at which the toner image is transferred to the fed sheet.

4 Claims, 4 Drawing Sheets

IMAGE FORMING DEVICE HAVING A SHEET DELAY TRANSFER MODE

BACKGROUND OF THE INVENTION

1. Field of the Invention

The present invention relates to an image forming device, particularly to an device comprising an intermediate transfer member to which a toner image formed on an image bearing member is transferred.

2. Background Information

Amongst image forming devices capable of simultaneously performing a plurality of images, such as a copying machine, a printer, and the like, an image forming device has been proposed in which a plurality of toner images having a desired image size are transferred to the intermediate transfer belt, and if the device runs out of paper while the plurality of toner images on the intermediate transfer belt are transferred to recording media, the transfer process will be interrupted, and the image forming process will be performed again after the image surface of the intermediate transfer belt is cleaned. See, for example, Japanese Patent Application Publication No. 11-311921.

However, in the above-described conventional image forming device, when cleaning the image surface of the intermediate transfer belt to which the images have been transferred, images which have not yet been transferred to recording media will also be removed from the intermediate transfer belt, resulting in wasteful toner consumption. Additionally, since the toner images which have been removed once must be formed again, this will reduce printing speed.

In view of the above-described disadvantage of the conventional technique, an object of the present invention is to provide an image forming device in which if a plurality of toner images are identical, and a previous toner image on the intermediate transfer member is out of sync with respect to sheet transfer, the toner images subsequent thereto will be transferred to recording media, thus reducing wasteful toner consumption and preventing a reduction in printing speed.

SUMMARY OF THE INVENTION

According to a first aspect of present invention, an image forming device comprises an image bearing member, an intermediate transfer member to which a toner image formed on the image bearing member is primarily transferred and which is able to simultaneously hold a plurality of toner images, a secondary transfer member for secondarily transferring the toner image held on the intermediate transfer member to a recording medium, a cleaning member for removing toner images from the intermediate transfer member after the secondary transfer, and a feeding member that feeds a recording medium into the secondary transfer member. The secondary transfer member includes a sheet-delay transfer mode in which if a previous toner image on the intermediate transfer member is out of sync with respect to the timing at which the previous toner image is to be transferred to the recording medium fed from the feeding member, the toner images on the intermediate transfer member subsequent thereto will be transferred to recording media.

According to the above-described constitution, if a previous toner image out of the plurality of toner images held on the intermediate transfer member is out of sync with respect to transfer timing, the toner images subsequent thereto will be transferred to recording media without interrupting the transfer of the toner images, thus preventing a reduction in printing speed and wasteful toner consumption.

According to a second aspect of the present invention, the sheet-delay transfer mode will be set if the plurality of toner images held on the intermediate transfer member are identical.

According to the above-described constitution, if the timing of a recording medium is out of sync when the first of a plurality of identical toner images is to be transferred, the second of the plurality of identical toner images will be the first to be transferred in the sheet-delay transfer mode, thus performing the transfer process without wasting the remaining toner images. Thus, toner consumption is reduced.

According to a third aspect of the present invention, a toner image that is identical to the previous toner image is formed on the image bearing member by interruption.

According to the above-described constitution, if the sheet-delay transfer mode is established, a subsequent toner image on the intermediate transfer member is transferred, and a previous toner image that has been removed due to being out of sync with the transfer timing is formed after the subsequent toner image by interruption, thus preventing a reduction in printing speed.

According to a fourth aspect of the present invention, a sheet rearrangement member is provided which rearranges the discharge order of the recording media to which the toner images have been transferred when operating in the sheet-delay transfer mode.

According to the above-described constitution, if the sheet-delay transfer mode is set, a toner image that is identical to the previous toner image will be formed by interruption. Even if the order at which the recording media is output is reversed and the transfer order of the toner images is incorrect, the sheet rearrangement member allows the sheets to be discharged in a correct order.

As described above, according to the present invention, if one of a plurality of toner images held on the intermediate transfer member is out of sync with the transfer timing, a subsequent toner image is transferred, and the previous toner image is formed after the subsequent toner image by interruption, thus providing an image forming device which consumes less toner and prevents a reduction in printing speed.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
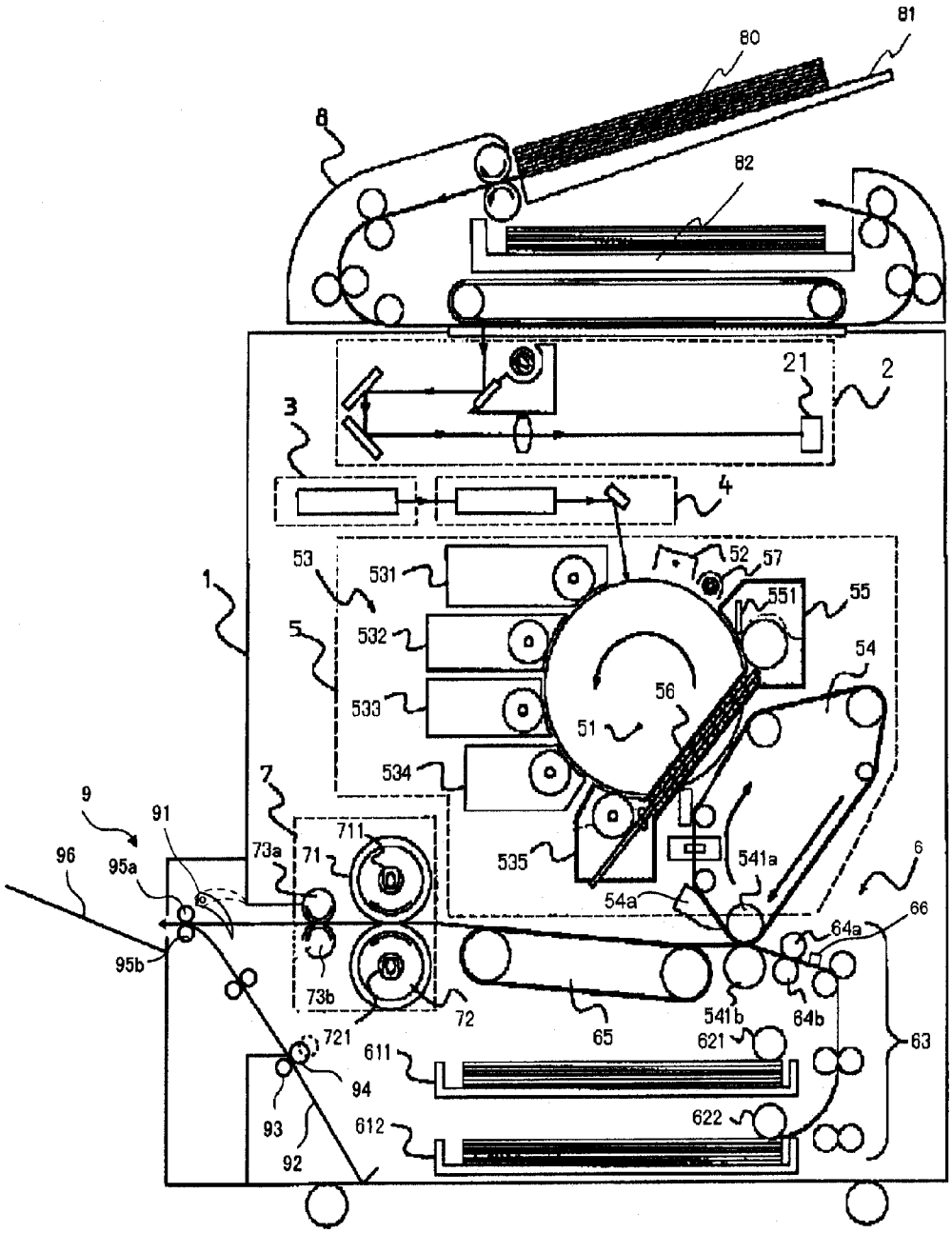
FIG. 1 is a cross-sectional view of an image forming device (multifunction device) according to the present invention

An embodiment is described below in which an image forming device according to the present invention is implemented in a color multifunction device which functions as a printer, a copying machine, or the like. As shown in FIG. 1, a color multifunction device 1 comprises a plurality of process execution units such as a scanner unit 2, an image processing unit 3, an LSU 4, an image forming unit 5, a sheet transport unit 6, a fixing unit 7, a DF unit 8, and a sheet rearrangement unit 9.

The DF unit 8 transports a plurality of sheets of an original document 80 placed on an original document tray 81 one by one to an original document read position in order to be processed by a scanner unit 2, and discharges the original documents that have been read to a receiving tray 82.

The scanner unit 2 will irradiate each sheet with light and pass the reflected light to a CCD image sensor 21 through a RGB filter in order to convert the reflected light into electric signals. The image processing unit 3 performs A/D conversion, shading compensation, color tone correction, and other image processes on the signal output from the CCD image sensor 21 in order to obtain final output image data, or convert output file data from a computer into output image data. The LSU 4 converts the output image data from the image processing unit 3 into laser light to thereby irradiate a photoreceptor drum 51.

The image forming unit 5 comprises the photoreceptor drum 51, a main charge unit 52, a developing unit 53, an intermediate transfer member 54, a cleaning unit 55, a recycle toner supply member 56, a cleaning member 54*a* that removes toner images from the intermediate transfer member 54 after the secondary transfer, and a discharge lamp 57. The developing unit 53 has five development sections including a cyan development section 531, a magenta development section 532, a yellow development section 533, a black development section 534, and a recycle development section 535. A toner cartridge is detachably attached to each development section. The toner cartridge is charged with toner particles of a corresponding color and supplies the toner particles to the development section.

In the main charge unit 52, a thin tungsten wire between 50 μm to 100 μm thick is stretched along the lengthwise direction of the photoreceptor drum 51 within a shield case having an aperture portion directed toward the photoreceptor drum 51, and a high voltage on the order of +5 kilovolts is applied to the wire to positively charge the photoreceptor drum 51. The LSU 4 irradiates the surface of the charged photoreceptor drum 51 with a laser light corresponding to image data in order to form an electrostatic latent image on the surface of the photoreceptor drum 51. The toner particles mixed and positively charged within the development unit 53 react to the bias voltage of a developing roller and the electric potential on the photoreceptor drum surface to form a toner image on the laser irradiated portion of the photoreceptor drum 51. The toner image is primarily transferred to a surface of the intermediate transfer member 54, and the intermediate transfer member 54 can simultaneously hold a plurality of toner images. In the following process, the toner particles on the photoreceptor drum 51 that have not been transferred are scraped off by a rubber blade 551 at the cleaning unit 55. Then, the photoreceptor drum 51 is neutralized by means of the discharge lamp 57 in order to lower the residual potential on the surface of the photoreceptor drum 51 and make it uniform, and then prepares for a next series of processes.

In a color image output mode, the above-described operation is repeated as to the cyan development section, the magenta development section, the yellow development section, and the black development section. The resultant toner images are superposed onto the intermediate transfer member 54, and the toner image is transferred to a sheet by a secondary transfer member (541*a*, 541*b*).

In a black and white image output mode, without operating the cyan development section 531, the magenta development section 532, or the yellow development section 533, an output is performed only at the black development section 534, or only at the recycle development section 535 if required.

The sheet transport unit 6 as a feeding member comprises paper feed cassettes 611 and 612, feed rollers 621 and 622, a vertical transport path 63, a pair of paper stop rollers 64*a* and 64*b*, and a transport belt 65. Each of the paper feed cassettes 611 and 612 is equipped with a sheet loading plate on which a plurality of sheets are placed, and the sheet loading plate is urged by a spring, a lift motor, or the like such that the uppermost sheet of the stacked sheets is brought into contact with the feed rollers 621 and 622. Upstream of the pair of paper stop rollers 64*a* and 64*b* is a sheet detection sensor 66 for detecting sheets, which functions both to perform transfer timing between the transported sheet and the toner image on the photoreceptor drum 51 in the image forming unit 5, and transfer a sheet to the image forming unit 5 after the sheet is stopped once for registration of the edge of the sheet. The transport belt 65 transports a sheet, to which unfixed toner particles have been transferred, to the fixing unit 7. Furthermore, the necessary number of transport rollers are placed along each of the transport paths.

The fixing unit 7 comprises a first heat roller 71 and a first heater 711 therein, a second heat roller 72 and a second heater 721 therein, and a pair of fixing/discharge rollers 73*a* and 73*b*. The heat rollers 71 and 72 employ materials having good thermal conductivity, such as fluorine coated aluminum. The heat rollers 71 and 72 are controlled at a predetermined temperature necessary for fixing by means of the built-in heaters 711 and 721. The first heat roller 71 is opposed to and in contact with the second heat roller 72 at an adequate pressure, and is driven by a driving means (not illustrated). The pair of heat rollers 71 and 72 are made of materials having good thermal conductivity, such as aluminum as a base material, and are covered with an elastic layer for ensuring a nip width for fixing. Although not illustrated, a claw member for peeling off sheets, a cleaning roller, and a cleaning web are provided with the respective rollers.

Figure 2:
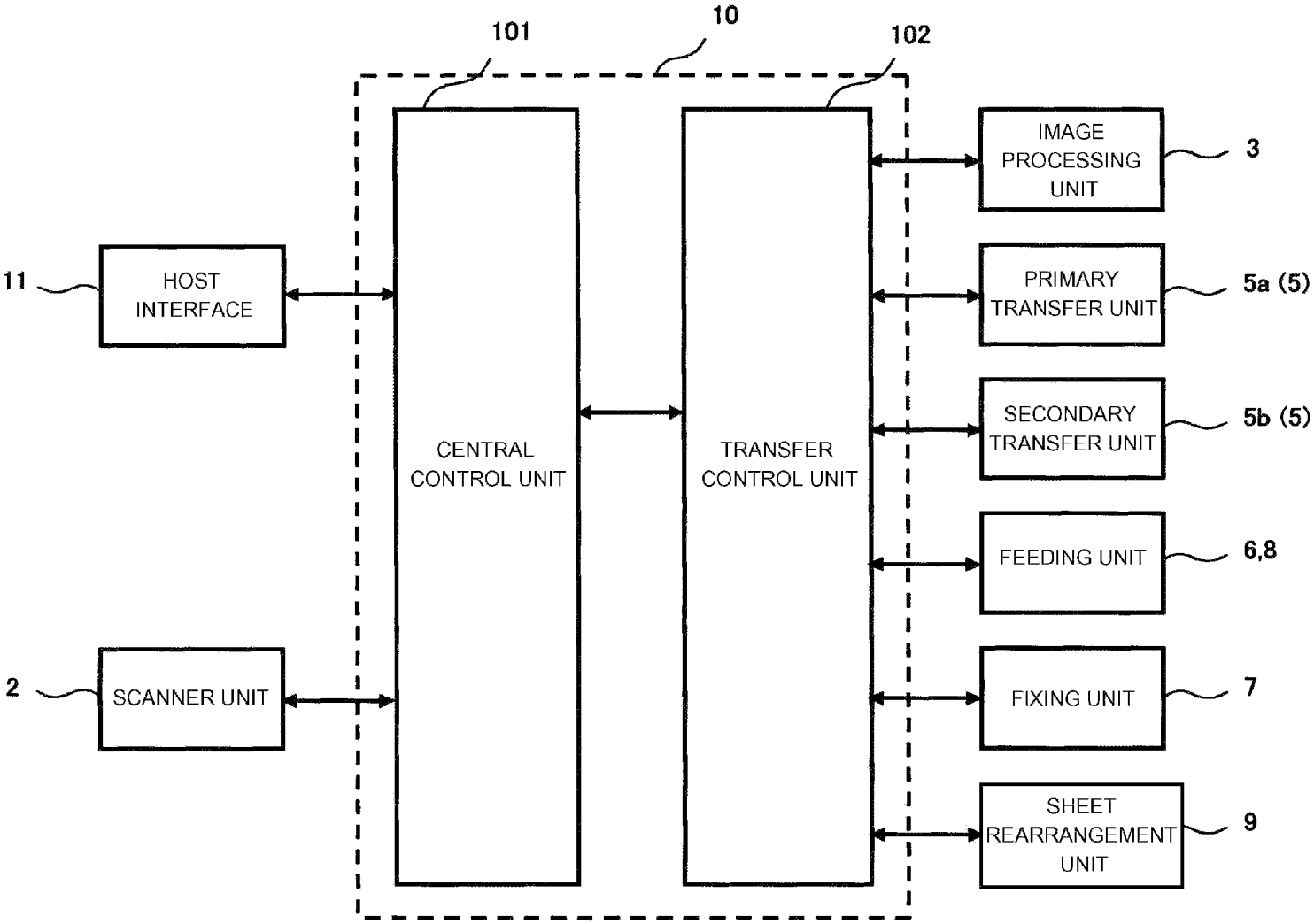
FIG. 2 is a block diagram of a controller.

A controller 10 of the image forming device is, as shown in FIG. 2, connected with the scanner unit 2 and a host interface 11, and comprises a central control unit 101 which processes image data from the original documents, image data transmitted from a host processor such as a personal computer, and the like, in order to control the overall operation of the device, and a transfer control unit 102 which controls operations of the image processing unit 3, a primary transfer unit 5*a*, a secondary transfer unit 5*b*, the feeding units 6 and 8, the fixing unit 7, and the sheet rearrangement unit 9.

The image forming process will now be described. In response to the operation of a start switch on an operation panel (not illustrated), an image of an original document is read out by the scanner unit 2 while a sheet of recording media set in the paper feed cassettes 611 and 612 is transported to the pair of paper stop rollers 64*a* and 64*b*. The surface of the photoreceptor drum 51 that has been uniformly charged is exposed in accordance with the image data read from the original document, and developed by the development unit 53 in order to form a toner image as a first image. The formed toner image is primarily transferred to the intermediate transfer member 54. Then, a second toner image is formed on the photoreceptor drum 51. While the toner image formed on the photoreceptor drum 51 is primarily transferred to the intermediate transfer member 54, a sheet to be transported to the pair of paper stop rollers 64*a* and 64*b* for waiting is transported at a predetermined timing, allowing the secondary transfer member to secondarily transfer the toner image on the intermediate transfer member 54 to the sheet.

Figure 3A:
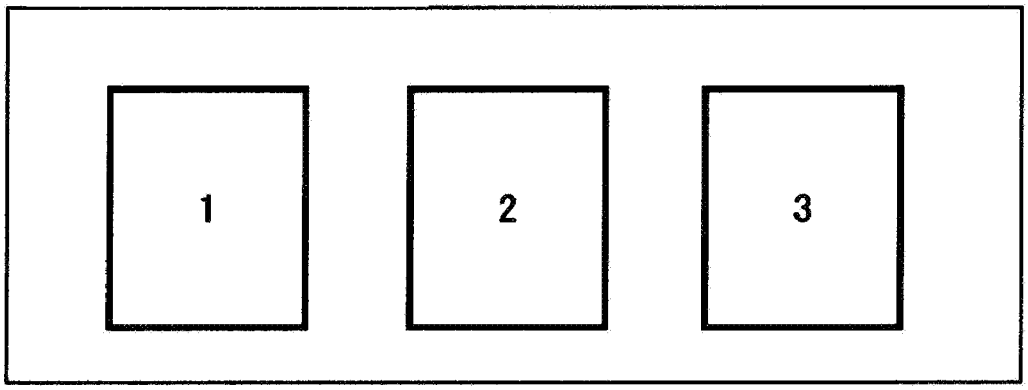
FIG. 3A shows a plurality of toner images on an intermediate transfer member.
Figure 3B:
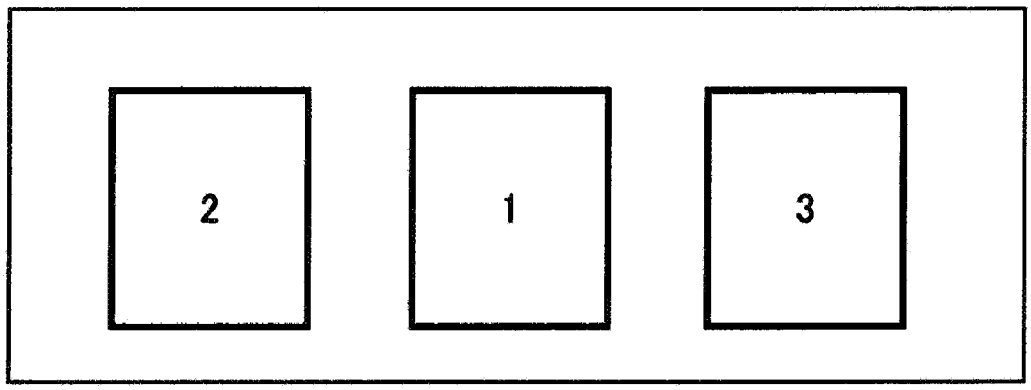
FIG. 3B shows a plurality of toner images on an intermediate transfer member.

If the sheet fed from the feeding member is not transported to the pair of paper stop rollers 64*a* and 64*b* at the predetermined timing when driving the pair of paper stop rollers 64*a* and 64*b* to secondarily transfer the toner image held on the intermediate transfer member 54 to the sheet, a sheet-delay transfer mode will be set such that the second toner image which has been transferred to the intermediate transfer member 54 will be transferred first. Here, it is assumed that identical toner images are sequentially formed from the left side to the right side shown in FIG. 3A. If the sheet detection sensor 66 detects an edge of the sheet, for example, and a sheet which has shifted to a waiting state is out of sync with respect to the transfer of the first toner image held on the transfer member 54, the sheet-delay transfer mode will be set such that the second toner image will be transferred first to the delayed sheet, and then, an image forming process as to the third toner image formed on the photoreceptor drum 51 will be interrupted in order to form the first toner image again as shown in FIG. 3B.

The sheet rearrangement unit 9 functions as a sheet rearrangement member for rearranging the discharge order of the sheets to which the toner images have been transferred in the sheet-delay transfer mode, and comprises a sheet transport path switch claw 91, a sheet accommodating unit 92, a sheet transport roller 93, a pressure fixing roller 94, a pair of sheet discharge rollers 95*a* and 95*b*, and a copy receiving tray 96. The sheet transport path switch claw 91 is pivoted about a horizontal axis in order to switch the transport destination of sheets between the copy receiving tray 96 and the sheet accommodating unit 92.

If the discharge order of sheets is different from the original order due to the sheet-delay transfer mode, a tip of a sheet will be temporarily transported onto the copy receiving tray 96 while being pinched by the discharge rollers 95*a* and 95*b*, the sheet transport path switch claw 91 is vertically pivoted, and then the discharge rollers 95*a* and 95*b* are rotated in reverse to switch back the sheet to the sheet accommodating unit 92 so as to be discharged in a correct order. If the next toner image, that is, the toner image formed as the first toner image by interruption (see FIG. 3B) is transferred to the sheet, and the sheet is discharged, the waiting sheet to which the second toner image has been transferred is pinched between the pressure fixing roller 94 and the sheet transport roller 93 so as to be transported to the pair of sheet discharge rollers 95*a* and 95*b*. Finally, the sheet is discharged to the copy receiving tray 96 by the pair of sheet discharge rollers 95*a* and 95*b*. If there is no need to rearrange the discharge order of sheets, that is, if the first image and the second image are identical, the sheet transport path switch claw 91 will pivot to a horizontal state, as shown in broken lines in FIG. 1, to directly discharge the sheets through the pair of fixing/discharge rollers 73*a* and 73*b* to the copy receiving tray 96.

Figure 4:
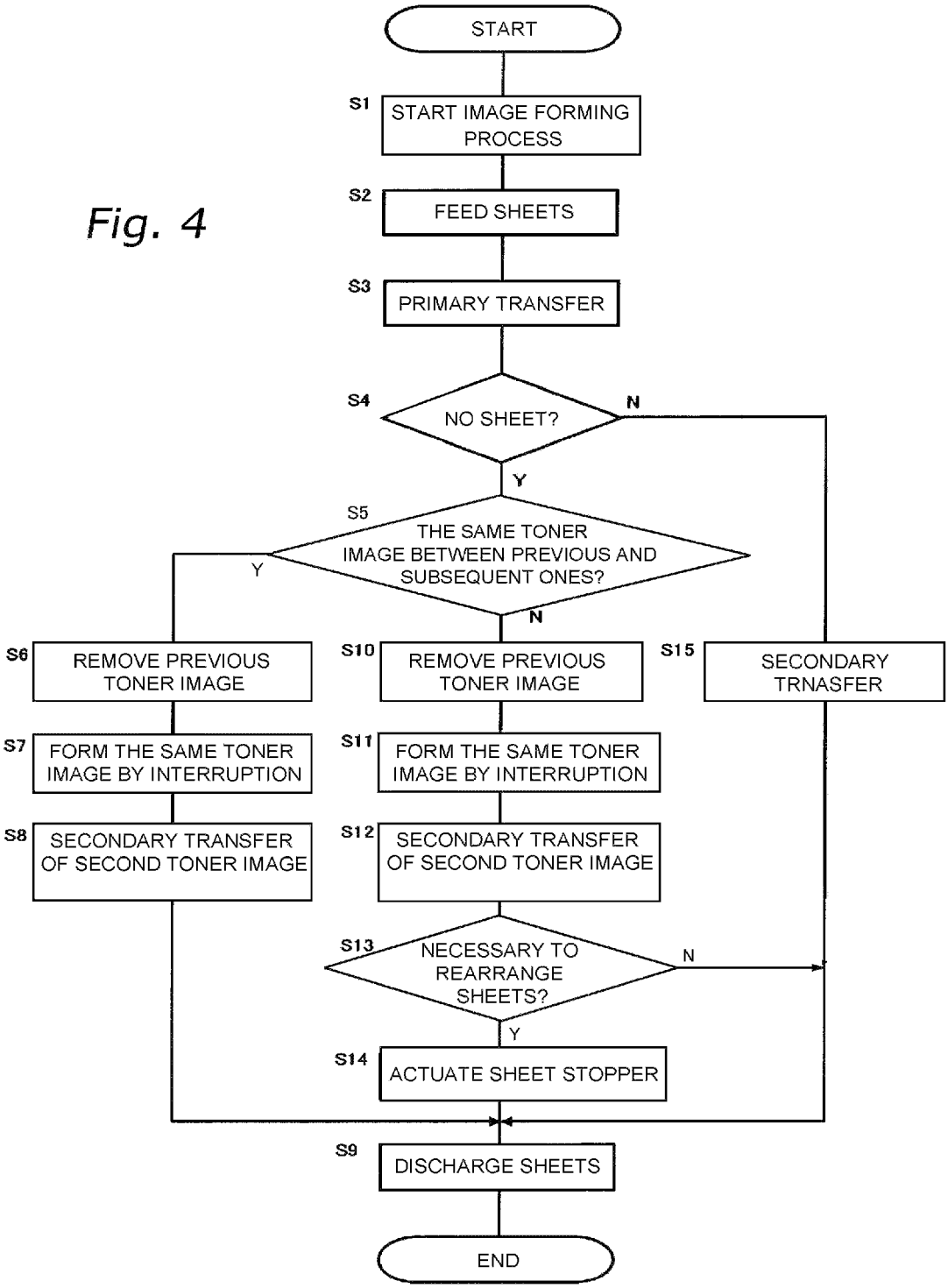
FIG. 4 is a flowchart showing a process of the present invention.

The flowchart in FIG. 4 will be employed to describe a process in which the transport of a sheet fed from the feeding member is out of sync with respect to the transfer of a previous toner image on the intermediate transfer member. When the start switch is operated, an image forming process is performed. That is, the reading of an original document is started at the scanner unit 2 while one of the sheets set in the paper feed cassettes 611 and 612 is transported to the pair of paper stop rollers 64*a* and 64*b* (S1, S2). The photoreceptor drum 51 is exposed and a toner image is developed on the photoreceptor drum 51 in accordance with the image data read from the original document. The toner image is primarily transferred to the intermediate transfer member 54 (S3). After the sheet detection sensor 66 detects the edge of the fed sheet, the sheet waits for a predetermined period of time while forming a loop around the pair of paper stop rollers 64*a* and 64*b* in order to adjust the edge of the sheet.

If no sheet is in a waiting state at the predetermined timing when driving the pair of paper stop rollers 64*a* and 64*b* to secondarily transfer the toner image on the intermediate transfer member 54 to the sheet (S4), that is, if it is determined that no sheet is detected by the sheet detection sensor 66 when, for example, the first toner image and the second toner image are based on the same original image (S5), the first toner image will be removed by the cleaning unit without being transferred, and the same toner image will be formed after the second image by interruption (S6, S7).

Next, the pair of paper stop rollers 64*a* and 64*b* is driven at a predetermined timing to transfer the second toner image to the delayed sheet in the waiting state, and whereby the second toner image is secondarily transferred to the first sheet (S8). Then, the previous toner image that is formed after the second toner image by interruption is secondarily transferred to a second fed sheet, and discharged in turn (S9). Here, although the previous image and the subsequent image to be formed on the intermediate transfer member 54 are reversed, the images are identical, thus causing no problem.

In step S5, if the first toner image and the second toner image are based on different original documents, like in steps S6, S7, and S8, the first toner image will be removed by the cleaning unit without being transferred, the same toner image is formed after the second toner image by interruption (S10, S11), and then the pair of paper stop rollers 64*a* and 64*b* is driven at a predetermined timing in transferring the second toner image to the delayed sheet in a waiting state. Thus, the second toner image is secondarily transferred to the first sheet (S12).

Here, if the paper to which the second toner image is transferred is discharged first, the discharge order of the sheets will be different than the order of the sheets of the original document, and thus it will be determined that it is necessary to rearrange the sheets (S13), and the sheet transport path switch claw 91 will be actuated as a sheet rearrangement member in order to rearrange the sheets so as to initially discharge the sheet with the first toner image (S14). The sheet transport path switch claw 91 will pivot vertically to guide the first sheet, to which the second toner image has been transferred, into the sheet accommodating unit 92 for temporary waiting.

After the second sheet to which the first toner image has been transferred by interruption is discharged, the waiting sheet is then discharged (S9). In this manner, when the sheet-delay transfer mode is in operation, even if the order of the sheets to which the toner images have been transferred is different than the order of the sheets of the original document, the sheets will be rearranged and then discharged in the same order as the sheets of the original document by the sheet rearrangement member.

In addition, if it is determined that the sheet detected by the sheet detection sensor 66 is in sync with the timing of the transfer of the first toner image in Step S4, the toner image will be secondarily transferred from the intermediate transfer member 54 to the sheet (S15), and the sheet will be discharged (S9).

Thus, if a plurality of identical toner images are formed, and one of them is out of sync with the secondary transfer thereof to a sheet, the first toner image will be removed, a second toner image will be transferred to the sheet, and then the first image will be formed again and transferred to another sheet. Thus, it is possible to prevent a reduction in printing speed. In addition, there is no need to eliminate the second or later toner images, and thus toner consumption can be reduced.

Another embodiment will now be described. In the above-described embodiment, even if the first toner image and the second toner image are based on different original documents, the provision of the sheet rearrangement member enables the sheet-delay transfer mode to be set. However, if the sheet rearrangement member is not provided, an image forming process as to the second or later toner image can be suspended, and the first toner image can be held without being removed so as to be transferred to a delayed sheet which has been shifted to a waiting state, or in the alternative, all the toner images formed on the intermediate transfer member 54 can be removed by a cleaning process, and then, an image forming process can performed again from the first toner image.

In the above-described embodiment, if identical toner images are sequentially formed, and one of them is out of sync with the toner image transfer timing, the previous toner image will be formed immediately after the subsequent toner image by interruption. However, if a plurality of identical toner images are sequentially formed, the previous toner image may be formed at any of the image forming processes of these subsequent toner images by interruption.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2005-037789. The entire disclosure of Japanese Patent Application No. 2005-037789 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An image forming device, comprising:

an image bearing member;

an intermediate transfer member to which a toner image formed on the image bearing member is transferred, and the intermediate transfer member being configured to hold simultaneously a plurality of sequentially formed toner images;

a secondary transfer member transferring the toner image held on the intermediate transfer member to a transfer medium;

a cleaning member removing toner images from the intermediate transfer member after the secondary transfer;

a feeding member feeding a transfer medium into the secondary transfer member; and a controller controlling a sheet-delay transfer mode which includes a subsequent toner image of the plurality of toner images on the intermediate transfer member being transferred to a recording medium, the subsequent toner image being transferred to the recording medium before a previous toner image and a further subsequent toner image transfer being interrupted in order to form the previous toner image when a transfer of the previous toner image of the plurality of toner images on the intermediate transfer member is out of sync with the timing at which the previous toner image is to be transferred to the transfer medium fed from the feeding member.

2. An image forming device according to claim 1, wherein the sheet-delay transfer mode is set when the plurality of toner images held on the intermediate transfer member is identical.

3. An image forming device according to claim 1, wherein a toner image of the plurality of toner images that is identical to the previous toner image is formed on the image bearing member by interruption.

4. An image forming device according to claim 1, further comprising a sheet rearrangement member that rearranges the discharge order of the recording media to which the toner images have been transferred when operating in the sheet-delay transfer mode so that the recording medium having the previous toner image is discharged before the recording medium having the subsequent toner image, which is discharged before the recording medium having the further subsequent toner image is discharged.

* * * * *